United States Patent [19]

Aschenbach

[11] Patent Number: 4,536,736

[45] Date of Patent: Aug. 20, 1985

[54] THERMOSTAT

[75] Inventor: Louis F. Aschenbach, Aloha, Oreg.

[73] Assignee: Eaton Corporation, Cleveland, Ohio

[21] Appl. No.: 608,320

[22] Filed: May 8, 1984

[51] Int. Cl.[3] ..... H01H 37/36

[52] U.S. Cl. ..... 337/317; 200/153 V; 200/286; 337/299

[58] Field of Search ..... 337/317, 318, 319, 321, 337/323, 330, 299; 200/153 V, 153 T, 286

[56] References Cited

U.S. PATENT DOCUMENTS 2,260,014 10/1941 Ettinger ..... 337/318

2,804,525 8/1957 Mantz ..... 337/317

*Primary Examiner*—Harold Broome

*Attorney, Agent, or Firm*—C. H. Grace; R. A. Johnston

[57] ABSTRACT

A bulb-and-capillary type temperature sensor move a fulcrummed lever arm for effecting tripping of a snap-acting switch. The lever arm has a resilient bimetal strip cantilevered thereon which is biased at its free end away from the lever by an adjustment screw threaded through the lever arm. The lever arm contacts the temperature sensor and the bimetal strip contacts the switch for transmitting lever amplified sensor movement for switch actuation. The bimetal strip serves the dual function of ambient temperature compensation of switch calibration and absorbs sensor over-travel after switch tripping.

8 Claims, 4 Drawing Figures

THERMOSTAT

BACKGROUND OF THE INVENTION

The present invention relates to devices for actuating an electrical switch in response to a predetermined temperature, such devices being commonly referred to as thermostats. One well known type of thermostat employs a liquid filled sensing bulb connected via a capillary tube to a pressure responsive diaphragm which exerts a force on a moveable member for switch tripping in response to expansion of the liquid sealed within the capillary tube and bulb.

In such bulb-and-capillary tube type thermostats, the moveable output member is commonly capable of providing substantial force, but very little motion from the fluid expansion generated in response to the bulb sensing a desired temperature level. Accordingly, it has been past practice to employ a lever means to amplify the motion of the thermally responsive output member for providing sufficient motion to effect actuation or deactuation of the electrical switch. In arrangements where such a lever has been employed, it is known to have the thermally responsive output member contact a portion of the lever arm and the lever biased about a fulcrum to maintain lever contact with the thermally responsive output member. In such an arrangement, it is necessary to calibrate the switch position with respect to movement of the lever arm in order that the arm will effect switch operation at the desired temperature. Once such a calibration has been made, however, the calibration is suitable only for an initial temperature corresponding to the ambient temperature at which the switch was calibrated. If the ambient temperature surrounding the switch is substantially changed from that which calibration was performed, the calibration is shifted by virtue of thermal expansion or contraction of the fluid in the fluid filled reservoir and capillary causing a change in the value of the sensed temperature at which switch actuation occurs.

Attempts have been made heretofore to provide ambient temperature compensation for the aforementioned types of lever actuated thermostats in order to prevent the shift in calibration caused by changes in ambient temperature. It is known to provide such a thermostat having a switch actuating lever formed of a bimetal material such that warpage or deformation of the bimetal with changes in ambient temperature is designed to counteract the shift in the calibration and thereby maintain the trip point of the thermostat switch constant over a range of expected service ambient temperatures.

However, calibration of a thermostat having a bimetal switch actuating arm requires that after switch assembly the arm be subsequently bent or otherwise altered in configuration to accomplish the initial temperature calibration. This has been found to be a complicated and costly operation to perform during manufacturing. Thus, it has long been desired to find a way or means of providing ambient temperature compensation in a lever acutated thermostatic switching device which would render the assembled thermostat easy to calibrate during manufacturing.

SUMMARY OF THE INVENTION

The present invention provides a thermally actuated assembly for tripping an electrical switching mechanism at a predetermined value of sensed temperature. A bulb and capillary sensor employs fluid expansions against a diaphragm to provide a force output through a small movement acting on a lever arm which amplifies the motion. The switching device is tripped by movement of a lever arm pivoted about a fulcrum on the switch mount. The lever arm has a bimetal strip cantilevered therefrom; and, the relative position of the bimetal with respect to the lever is adjusted by a screw threadedly received in the lever arm. The bimetal member is resiliently deflectable to absorb over-travel of the force member subsequent to tripping of the switch. The bimetal arm deforms during changes in the ambient temperature to counteract the effects thereof to prevent shift in the calibration of the thermostat.

DETAILED DESCRIPTION

Figure 1:
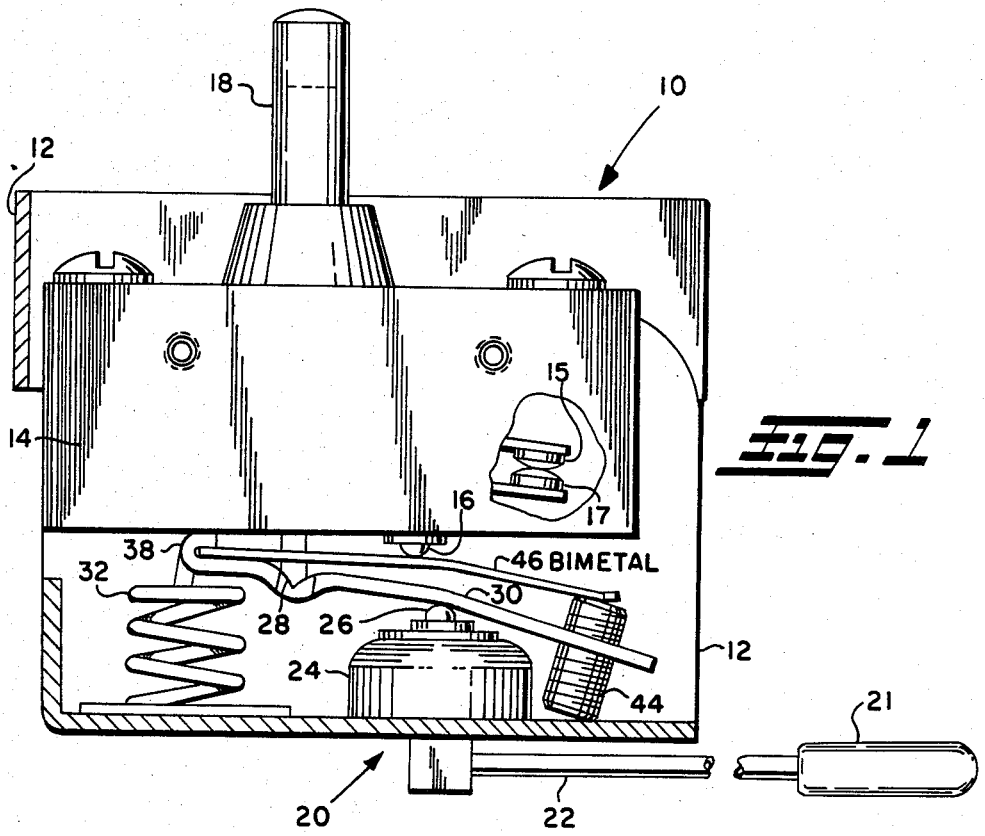
FIG. 1 is a side or elevation view of the thermostat assembly of the present invention.

Referring now to FIG. 1, the improved thermostat is indicated generally at 10 as having a base or mounting frame 12 with an electrical switch 14 mounted thereon. The switch preferably employs a set of snap-acting moveable contacts 15, 17 for making and breaking a circuit between a pair of electrical connecting terminals (not shown). The switch 14 has an actuator plunger or button 16, extending downwardly therefrom as shown in FIG. 1, and which is moveable in a vertical direction for effecting the snap-action or tripping of the switch 14. The switch 14 has a manually actuated reset plunger 18 extending from the top thereof for manual reset of the switch after thermal actuation.

A thermal sensing unit indicated generally at 20 is anchored to the lower flange of the mounting frame 12 and the thermal sensing unit employs a remote fluid filled bulb 21 attached via capillary 22 to a fluid filled reservoir 24 having therein a pressure responsive diaphragm (not shown) and piston member (not shown) operative in response to fluid pressure to cause upward movement of a force output member 26. The construction of the thermal sensing unit 20 is well known in the art.

A fulcrum or pivot 28 is provided on the base 12; and, in the present practice has a beveled edge which has registered thereagainst, intermediate the ends thereof, the substantially rigid lever arm 30.

The arm 30 is biased about the fulcrum 28 by a suitable spring 32 registered against the base and contacting one end of the lever 30, such that the lever 30 contacts the force output member 26 under the urging of the spring.

Figure 2:
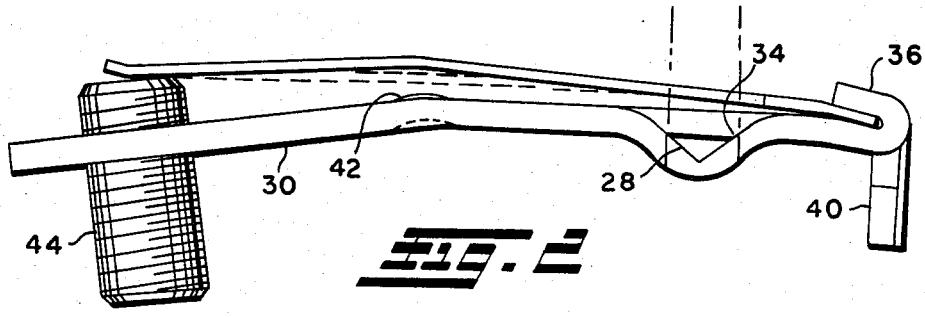
FIG. 2 is an enlarged view of the pivoted lever arm subassembly of the embodiment of FIG. 1.
Figure 3:
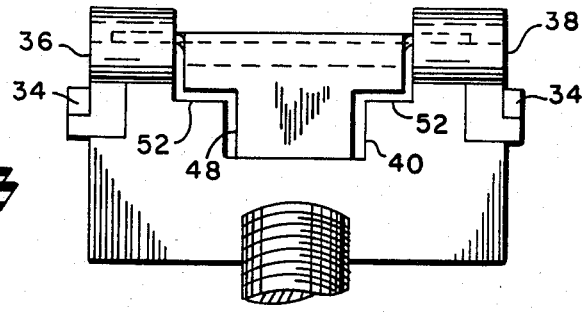
FIG. 3 is an end view of the subassembly of FIG. 2.

With reference to FIG. 2, the lever arm has a recessed portion 34 provided therein which is configured to accomodate the fulcrum 28. Referring to FIG. 2 and 3, the lever arm 30 has one end thereof bifurcated to form a pair of legs 36, 38 which are folded back on themselves to form the generally U-shaped configuration illustrated for one of the legs 36 in FIG. 2.

Referring to FIGS. 2 and 3, the portion of the lever 30 between the leg 36, 38 of the lever 30 is folded downwardly to form an end tab 40 therebetween which extends generally at right angles to the body of the lever 30 at the righthand end thereof as shown in FIG. 2. The lever arm 30 also has a dimpled or recessed portion 42 provided thereon and disposed intermediate the recess 34 and the lefthand end of the lever. Recess 42 is received over and contacts force output member 46. The lefthand end of lever arm 30 as shown in FIG. 2 has threadedly received therethrough an adjustment screw 44.

An elongated resilient, generally flat, spring member 46 has one end thereof received in the U-shaped notches of the legs 36, 38. The resilient member 46 also has an end tab 48 thereof bent downwardly to register against the tab 40 of the lever arm, such that the resilient member 46 extends in moment-resisting cantilever from the end of the lever arm.

The free end of the resilient member 46 is registered against and biased, in a direction away from the lever arm 30, by adjustment screw 44. In the presently preferred practice, the resilient member 46 comprises a bimetal element which at room temperature has the configuration shown in solid black line in FIG. 2; and, which, upon increasing ambient temperature, is deformed by the differential expansion of the bimetal to the position shown in dashed line in FIG. 2.

Figure 4:
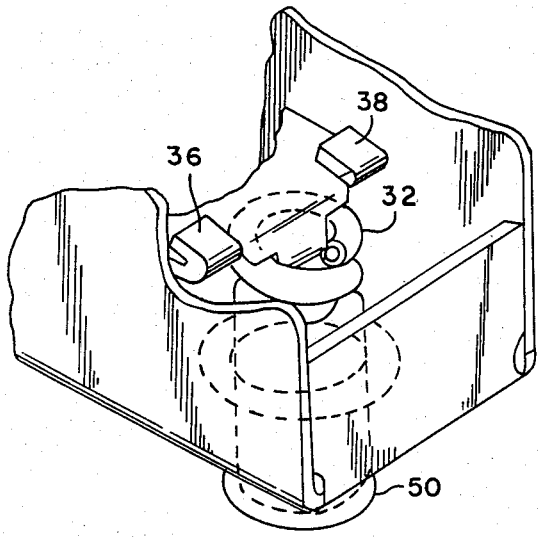
FIG. 4 is a portion of a perspective view of an alternate arrangement of the biased spring for the subassembly of FIG. 2.

Referring now to FIG. 4, the spring 32 is shown in an alternate mounting configuration wherein the spring extends to the base frame to register against the bottom of a cup 50 and the upper end of spring 32 is registered against shoulders 52 provided in the tab 40. Although the spring 32 is shown as a generally cylindrical coil spring, it will be understood that alternatively, a conically coiled spring may also be employed.

In the present practice of the invention, the subassembly of FIG. 2 is assembled into the switch base 12 with switch 14 and thermal sensor assembly 20. The adjustment screw 44 is then rotated until the resilient spring member 46 contacts the switch actuator 16.

The thermal sensor bulb 21 is exposed to the predetermined desired actuating temperature and the fluid expands to cause sensor 20 to move the force member 26 upward. With the sensor subjected to the fluid pressure corresponding to the predetermined actuation temperature, via capillary 22, the adjustment screw 44 is turned to spread spring 46 from lever 30 until the switch is tripped or actuated.

Thereafter, variations in the ambient temperature to which the lever arm and resilient member 46 are exposed cause the bimetal arm 46 to move in a direction to compensate for the increased ambient temperature. In the present practice of the invention, the thermostat is employed for typical applications wherein the trip point is set at any selected temperature in the range 115° F. through 140° F. It will be understood, however, that such temperature ranges are described as representative of particular applications and not as limiting with respect to the novel features of the invention.

It will be understood that as the fluid in the capillary is exposed to temperature in excess of the desired trip point temperature, the fluid in the capillary futher expands causing force member 26 to continue its upward movement and rotate the lever arm 30 additional amounts around fulcrum 28. This additional movement commonly referred to as overtravel, is absorbed by resilient deflection of the spring member 46 and thus prevents damage to the switch 14 by excess force application to the switch actuating plunger 16.

The present invention thus provides a novel thermostat having a lever arm actuated switch with a bi-metal resilient member attached to the lever arm for providing ambient temperature compensation and absorption of over-travel from the thermal sensing element.

The thermostat of the present invention provides a unique adjustment means on the lever arm assembly between the lever arm and the bimetal member for ease of calibration during manufacture. Although the invention has been described herein with respect to the presently preferred embodiment, it will be understood that the invention is capable of modification and variation and is limited only by the following claims.

I claim:

1. A thermostat comprising:

(a) base means;

(b) electrical switch means mounted on said base means having a moveable actuator member for effecting snap-action of a set of contacts;

(c) thermally responsive means operable to provide movement of a force member at a predetermined temperature;

(d) lever means pivotally mounted on said base means and operative upon pivotal movement to effect movement of said switch actuator member, said lever means including;

(i) an elongated rigid lever member having said pivotal mount disposed adjacent one end thereof;

(ii) an elongated bimetal spring member having one end thereof attached to said lever in the vicinity of said one end and extending therefrom in cantilever arrangement, (iii) adjustable means mounted on and carried with said lever member for adjusting the position of the free end of said bimetal member with respect to said lever member, wherein said lever means is disposed such that said force member contacts said elongated member for applying a force thereto effecting pivotal movement thereof and said bimetal member contacts said moveable actuator member for transmitting said force to effect switch snap-action, wherein after switch snap-action said bimetal member is resiliently deflected to absorb over travel of said lever member.

2. The thermostat defined in claim 1, wherein said adjustable means comprises a screw threadedly engaging said elongated member with one end of said screw contacting said bimetal member.

3. The thermostat defined in claim 1, wherein said bimetal member is cantilevered from one end of said elongated lever member.

4. A thermostat comprising:

(a) base means;

(b) electrical switch mounted on said base means having an actuator member moveable for effecting snap-action of a set of contacts;

(c) thermally responsive means operable to provide movement of a force member at a predetermined temperature;

(d) moveable means operable upon contact by said force member to pivot about a fulcrum on said base means and to effect movement of said switch actuator member, said moveable means including a bimetal member and a non-bimetal member operable to vary in response to ambient temperature changes the calibration of said force member with respect to said effecting movement of said actuator member and including means mounted on said non-bimetal member and carried therewith for adjusting the position of said bimetal member with respect to said non-bimetal member for calibrating switch actuator movement, wherein said bimetal member is operable to absorb over travel of said force member after said snap-action.

5. The thermostat defined in claim 4, wherein said bimetal member extends in cantilever generally wishbone arrangement from said non-bimetal member and said position adjusting means includes means threaded through one of said bimetal member and said non-bimetal member.

6. A thermostat comprising:

(a) base means;

(b) electrical switch means mounted on said base means and having an actuator member operable upon movement for effecting relative movement of the contacts of an electrical contact set, one with respect to the other;

(c) thermal sensing means operable in response to a predetermined level of sensed temperature to provide movement of a force member;

(d) lever means pivotal about a fulcrum on said base means and operable in response to movement of said force member to effect movement of said switch actuator, said lever means including a rigid member and resiiently deformable member operable to absorb over travel of said lever means subsequent to said effecting of relative contact movement.

(e) adjustment means mounted on and carried within said rigid member for adjusting the initial position of said resiliently deformable member with respect to said rigid member for calibrating said lever means for said switch actuator movement.

7. The thermostat defined in claim 6, wherein said resiliently deformable member comprises a bimetal member.

8. The thermostat defined in claim 6, wherein said lever means includes means for adjusting the relative position of said resiliently deformable member with respect to said rigid member.

* * * * *